United States Patent [19]

Chu et al.

[11] Patent Number: 4,477,317

[45] Date of Patent: Oct. 16, 1984

[54] ALUMINUM SUBSTRATES USEFUL FOR LITHOGRAPHIC PRINTING PLATES

[75] Inventors: Simon L. Chu, Dobbs Ferry; Eugene Golda, Monsey; Jen-Chi Huang, Ossining; Alan Wilkes, Brewster, all of N.Y.

[73] Assignee: Polychrome Corporation, Yonkers, N.Y.

[21] Appl. No.: 547,194

[22] Filed: Oct. 31, 1983

Related U.S. Application Data

[63] Continuation of Ser. No. 332,795, Dec. 21, 1981, abandoned, and a continuation-in-part of Ser. No. 129,432, Mar. 11, 1980, abandoned, which is a continuation of Ser. No. 800,132, May 24, 1977, abandoned.

[51] Int. Cl.[3] ..... B41N 3/02; C25D 5/44

[52] U.S. Cl. ..... 204/33; 101/459; 204/129.4

[58] Field of Search ..... 101/401.1, 459; 204/17, 204/33, 129.4

[56] References Cited

U.S. PATENT DOCUMENTS

| | | | |
|---|---|---|---|
| 308,043 | 11/1884 | Shaw | 101/401.2 |
| 993,938 | 5/1911 | Achert | 101/401.1 |
| 2,344,510 | 3/1944 | Hagelin | 101/459 |
| 3,072,546 | 1/1963 | Wruck | 204/33 |
| 3,073,765 | 1/1963 | Adams | 101/459 |
| 3,223,032 | 12/1965 | Beardman | 101/459 |
| 3,834,998 | 9/1974 | Watanabe | 204/33 |
| 3,887,447 | 6/1975 | Sheasby | 101/459 |
| 3,929,591 | 12/1975 | Chu | 204/17 |
| 3,980,539 | 9/1976 | Lloyd | 101/459 |
| 4,052,275 | 10/1977 | Gumbinner | 101/459 |
| 4,072,589 | 2/1978 | Golda | 204/129.4 |
| 4,116,695 | 9/1978 | Mori | 101/459 |
| 4,183,788 | 1/1980 | Fromson | 101/459 |
| 4,360,401 | 11/1982 | Gray | 101/459 |

FOREIGN PATENT DOCUMENTS

| | | | |
|---|---|---|---|
| 1113508 | 5/1968 | United Kingdom | 101/459 |
| 1224226 | 3/1971 | United Kingdom | 101/459 |

*Primary Examiner*—Clyde I. Coughenour

[57] ABSTRACT

A method for the production of aluminum substrates useful in the production of lithographic printing plates which comprises first mechanically graining at least one surface of an aluminum sheet to obtain a pumice grained surface of the aluminum sheet, and then electrolytically etching said grained surface with alternating current.

5 Claims, No Drawings

ALUMINUM SUBSTRATES USEFUL FOR LITHOGRAPHIC PRINTING PLATES

This application which is a continuation of Ser. No. 332,795, filed Dec. 21, 1981, now abandoned, is a continuation-in-part of copending application Ser. No. 129,432 filed Mar. 11, 1980 now abandoned, which in turn was a continuation of Ser. No. 800,132 filed May 24, 1977, now abandoned.

This invention relates to the treatment of aluminum surfaces, and more particularly to the treatment of aluminum surfaces to provide a surface thereon suitable for use in the production of lithographic printing plates.

There are many methods and processes which have been heretofore employed in the treatment of aluminum surfaces to render them suitable for use in the production of lithographic printing plates. One such method involves the electrolytic treatment of aluminum, for example, electrolytic etching by use of a hydrochloric acid electrolyte, for such purpose. Various prior art publications, for example, U.S. Pat. Nos. 3,072,546 and 3,073,765 and British Pat. Nos. 879,768 and 896,563 describe the treatment of aluminum surfaces with hydrochloric acid while applying an alternating current to the aluminum plates to render the plates suitable for lithographic use. While this treatment has been taught to be satisfactory, it apparently only functions properly with relatively pure aluminum, such as aluminum alloys having less than 0.5% impurity, such as Aluminum Association Alloy 1145. In addition, in the treatment of such Aluminum Association Alloys as 1100, a relatively large amount of electrical power has been required to obtain the degree of etching desired. Furthermore, heretofore, in the electrolytic etching of relatively impure aluminum sheeting for lithographic purposes, it has been experienced that an excessive amount of black smut is created on the aluminum surface which requires additional subsequent treatment of the aluminum in order to render it suitable for lithographic use. It has also been found in the practice of the prior art processes that uniform etching of the surface is not obtained and the character of the grain imparted to the surface is not consistent, portions thereof being relatively coarser than others, thus yielding an undesirable irregular surface which is not ideally suitable for lithographic use. When the surface of the aluminum sheet is irregular and non-uniform, it can interfere with the subsequent printing process when the surface is subsequently coated with a photosensitive resin as is employed in normal lithographic processes as is well known to the skilled worker.

Heretofore, various suggestions have been made to overcome the disadvantages encountered in the practice of the prior art processes. One such suggestion in U.S. Pat. No. 3,963,594 involves the use of a hydrochloric acid and gluconic acid electrolyte for etching. Other suggestions such as those contained in U.S. Pat. Nos. 3,342,711; 3,365,380; 3,366,558; and 3,891,516 refer to an electrolytic polishing effect obtained on aluminum and other metals using a mixture which may include various electrolytes such as sulfuric acid and gluconic acid. Japanese Pat. No. 47-44046 also suggests a method of pretreating aluminum surfaces, also without solving the prior art problems. However, none of these proposed methods have been found to be completely successful in overcoming the disadvantages of the prior art methods.

It has now been discovered that by the practice of the instant invention the disadvantages of the prior art may be successfully avoided while still obtaining the desirable results required. By practice of the instant process, it has been found that aluminum surfaces may be roughened more uniformly, imparting a surface character thereto that is very satisfactorily conducive to their subsequent use for lithographic purposes, than was previously known or anticipated. In addition, by the practice of the instant invention, it is now possible to employ less pure alloys of aluminum, for example, Aluminum Association Alloys 1100 and 3003, to obtain aluminum sheets which possess relatively uniformly roughened surfaces which are eminently suitable for use in the production of lithographic printing plates, while at the same time avoiding the detrimental characteristics and properties heretofore existant in such materials. More particularly, the practice of the instant invention will permit the use of a wider variety of aluminum alloys for lithographic purposes, while at the same time imparting to the aluminum surfaces a consistent and uniform surface eminently suitable for use in the production of lithographic printing plates. In addition, the practice of the instant invention results in economics in the use of electric power required to impart the desired roughened surface to the aluminum surfaces treated hereunder and also permits a less critical control of the electrolytic bath solutions employed herein and an extension of the effective life of said baths.

The practice of the process of the instant invention requires that the aluminum surface which is to be electrolytically etched for lithographic purposes must first be mechanically grained prior to the electrolytic treatment thereof. More particularly, in the production of lithographically useful aluminum sheets in accordance with the process of the instant invention, at least one surface of aluminum sheet useful for lithographic purposes hereunder, is first mechanically grained by utilizing wet mass graining to roughen the surface, and the resulting grained surface is then electrolytically etched to yield a consistent and uniformly roughened surface eminently suitable for further treatment to produce very satisfactory lithographic printing plates. The aluminum sheets which may be employed in the practice of this invention, include those which are made from aluminum alloys which contain substantial amounts of impurities, including such alloys as Aluminum Association Alloys 1100 and 3003. The thickness of the aluminum sheets which may be employed in the practice of this invention may be such as are usually and well known to be employable for such purpose, for example, those which are from 0.004 inches to 0.025 inches in thickness. However, the exact choice of aluminum sheet may be left to the discretion of the skilled worker.

The aluminum sheets employed in the practice of the present invention must be mechanically grained by wet mass graining, and the use of a pumice containing wet mass has been found to be particularly preferred and advantageous. Wire brushing, sand blasting, dry brush graining and ball graining are known methods for mechanically graining or roughening the surface of aluminum, as discussed in "Photography and Platemaking for Photo-Lithography" by I. H. Sayre (Lithographic Textbook Publishing Co.) pages 39–48. However, it has been found that the use of wet mass graining to obtain a pumice grained aluminum surface is crucial in order to achieve the advantages of the present invention. More particularly, it has been found to be actually disadvantageous to use the wire brushing, sand blasting, dry brush graining or ball graining techniques in the practice of the present invention. Thus, it is essential for the present purpose to use wet mass graining to obtain a pumice grained aluminum surface.

After the surface of the aluminum has been mechanically grained in accordance herewith, the thus pumice grained surface is then electrolytically etched. The electrolytic etching process of the present invention requires the electrolytic treatment of the mechanically grained aluminum with alternating current in a suitable electrolyte bath. The electrolytic baths employable in the practice of this invention include those mineral acids such as hydrochloric or nitric acid, or combinations thereof. It has been found that the most satisfactory results are obtained when a hydrochloric acid electrolyte is employed. The conditions under which the electrolytic etching is carried out are those generally employed for such purposes. For example, the current density employed for such purposes may vary from 2 to 100 amps per square decimeter of aluminum surface being treated. The temperature at which the electrolytic etching may be performed may vary from about 20 degrees to 80 degrees Centigrade. The time period during which the electrolytic etching may be carried out may vary from about 0.15 to 2.0 minutes per square foot of aluminum surface being treated. The exact parameters of the conditions under which the electrolytic etching may be carried out may be varied and are within the purview of the skilled worker depending upon the results wished to be achieved in each specific case.

Subsequent to the electrolytic etching of the aluminum surface hereunder, the thus etched aluminum may be further treated to produce the desired lithographic printing plates. Thus, the electrolytically etched aluminum may be subsequently coated with a lithographically suitable photosensitive coating for such purposes, or alternatively, the electrolytically etched surface may be anodized, for example, with direct current in a suitable electrolyte, such as sulfuric acid, prior to the application to the thus anodized surface of a lithographically suitable photosensitive coating.

The invention may be illustrated by the following Examples:

EXAMPLE 1

A web of aluminum foil, AA 1100 alloy, was grained in an aqueous slurry containing 5.5% of pumice powder and 2.8% quartz powder with a constant pressure nylon brush, under the following conditions:

Web Speed: 15 ft/minute
Brush Speed: 400 RPM with oscillation
Nylon Brush Thickness: 0.012 in.
Reflectance of grained surface: 18%±2
Roughness of grained surface: $R_z=2$ The thus pumice grained aluminum was then chemically cleaned and desmutted and subjected to electrolytic etching by treating the aluminum web having a speed of 3.0 ft/min. with alternating current of 175 amps for a period of 35 seconds in an aqueous electrolyte containing an HCl electrolyte at a concentration of 2.5% by weight at room temperature. The resultant electrolytically etched aluminum is then rinsed with water and dried.

EXAMPLE 2

A sheet of aluminum foil AA 1100 alloy was grained and electrolytically etched in accordance with the procedures set forth in Example 1 (Plate A). A second sheet of aluminum foil, AA 1100 alloy, was electrolytically etched without prior graining in accordance with the electrolytic graining procedures set forth in Example 1 (Plate B). Plate A and Plate B were then coated with the same suitable photosensitive coating to prepare presensitized lithographic printing plates which were then exposed to a light source through a negative transparency and then developed to prepare the finished printing plates. Each plate was mounted on a web offset press and run for printing on 48 pound abrasive newspaper stock and standard black offset ink at the rate of 10,000 impressions per hour. After 40,000 impressions, wear was observed on both the plate and the copies obtained with Plate B. After 88,000 impressions no wear was observed with either the plate or the copies obtained with Plate A.

This example demonstrates that the printing plate obtained with the instant invention provides a longer, cleaner running printing plate than is obtained without the practice of this invention.

EXAMPLE 3

In order to obtain a roughness characteristic as measured by standard Perthometer test ($R_z$) of the aluminum surface which is satisfactory for use in the production of printing plates, it is necessary to electrolytically etch the surface of the aluminum, which requires a certain amount of power consumption. By the practice of the instant invention it has been found that in order to obtain a satisfactory roughness characteristic, i.e. $R_z=4$, a substantial savings in the use of electric power can be realized. It has been found that the practice of the instant invention will save substantial electric power when the aluminum is electrolytically etched as can be seen from the following Table A:

TABLE A

| Aluminum Surface | Required Power (KWH/ft$^2$) for Electrolytic Etching | Power Saved |
|---|---|---|
| Smooth Al Alloy 1100 | 0.0165 | 0 |
| Mechanically grained Al Alloy 1100 | 0.0125 | 24% |

The foregoing results demonstrate that the practice of the instant invention provides substantial savings in the use of the electric power required for production of lithographic printing plates.

EXAMPLE 4

The procedure of Example 1 is followed except that the wet mass slurry has a concentration of 8.3 percent pumice, to achieve equivalent results.

EXAMPLE 5

The procedure of Exampe 1 is followed except that an equivalent amount of nitric acid is substituted for hydrochloric acid yielding equivalent results.

The invention may be variously otherwise embodied within the scope of the appended Claims.

What is claimed is:

1. A method of producing a lithographic printing plate which comprises:

(a) pumice graining the smooth surface of an aluminum sheet; utilizing a wet slurry containing about 5.5 percent or more pumice alone or in combination with other abrasive materials (b) cleaning the surface of the resulting pumice grained aluminum sheet;

(c) electrolytically graining said aluminum surface in an aqueous electrolyte whose solute consists essentially of hydrochloric acid, nitric acid, or combinations thereof at a time period of from about 0.15 to 2 minutes per square foot of aluminum surface being treated and at an alternating current density of from 2 to 100 amps per square decimeter wherein the electrolyte is maintained at from about 20 to 80 degrees C.;

(d) rinsing said aluminum sheets with water;

(e) drying said aluminum sheet; and (f) coating said aluminum sheet with a lithographically suitable photosensitive composition.

2. The method of claim 1 wherein the electrolyte is hydrochloric acid.

3. The lithographic printing plate produced by the method of claim 1.

4. The method of claim 1 wherein the electrolyte is nitric acid.

5. The method of claim 1 wherein the aluminum sheet is anodized with direct current in a sulfuric acid electrolyte prior to the application of the lithographically suitable photosensitive composition.

* * * * *